United States Patent [19]

Beale

[11] Patent Number: 4,888,951

[45] Date of Patent: Dec. 26, 1989

[54] PHASE SYNCHRONIZATION AND VIBRATION CANCELLATION FOR FREE PISTON STIRLING MACHINES

[75] Inventor: William T. Beale, Athens, Ohio

[73] Assignee: Sunpower, Inc., Athens, Ohio

[21] Appl. No.: 376,231

[22] Filed: Jul. 3, 1989

[51] Int. Cl.[4] ..... F02G 1/04; F02G 1/06

[52] U.S. Cl. ..... 60/520

[58] Field of Search ..... 60/520

[56] References Cited

U.S. PATENT DOCUMENTS

Re. 30,176 12/1979 Beale ..... 60/520

4,476,681 10/1984 Dineen ..... 60/520

*Primary Examiner*—Allen M. Ostrager

*Attorney, Agent, or Firm*—Frank H. Foster

[57] ABSTRACT

An apparatus and method for synchronizing the phase of a pair of free piston Stirling machines without changing the design parameters or operating characteristics from the operating mode of each machine alone. Energy is coupled from corresponding gas spaces of each machine into an interconnected sonic transmission line to generate a standing wave in the transmission line. Preferably the transmission line is a tube which is, for example, one wavelength long to cause the two machines to run with their pressure waves in phase.

12 Claims, 2 Drawing Sheets

PHASE SYNCHRONIZATION AND VIBRATION CANCELLATION FOR FREE PISTON STIRLING MACHINES

TECHNICAL FIELD

This invention relates generally to free piston Stirling machines, such as motors and heat pumps or refrigerators and more particularly relates to an apparatus and method for causing two separate machines to run at a desired phase angle, such as 360 degrees, so that, among other things, they can be aligned and operated to have the mechanical vibration energy from each machine cancelled to provide smooth running operation.

BACKGROUND ART

Free piston Stirling motors and heat pumps are exceptionally energy efficient and are durable mechanical devices for converting heat energy to mechanical energy or for converting mechanical energy to heat pumping work. Under some design conditions it is desirable to operate two or more free piston Stirling machines in a desired phase synchronism, that is so that the two engines run at a relatively constant phase angle between the periodic, approximately sinusoidal, motion of each of the two machines.

In the past multiple Stirling engines have been connected together in a ganged arrangement in which work spaces are interconnected so that the machine operates with a work space shared commonly by two different machines. The volume of the workspace is the sum of the volumes of each space plus the interconnection volume. Such machines operate with a 0 degree phase angle between the gas pressure waves of the different machines. This system provides adequate operation if the two machines are positioned relatively closely together. Close spacing is necessary because the interconnection between the two gas spaces is a part of the total work space volume seen by each of the two interconnected free piston Stirling engines. If the volume of the corrosion space becomes excessively large, the machines cannot operate effectively.

Similarly, the prior art has also directly connected together the displacer gas spring of each of two machines so that they act as a common gas spring in order to operate two free piston Stirling engines along an axis and cancel their vibrations. This arrangement, however, is also limited because the gas springs must be positioned very close together in the same housing so that the total gas spring volume is sufficiently small to provide the necessary spring constant needed to act upon the vibrating masses and operate the machine properly. The above system therefore required that the heat input ends of each of the two engines be at axially opposite ends of the coupled machines, which therefore required two separate heat energy inputs to the two separate spaced hot ends of the two different free piston Stirling machines.

Sometimes it is desirable, however, to utilize two separate free piston Stirling engines and to be able to synchronize their operation without requiring any particular portion of either machine to be physically closely near a physical portion of the other machine. For example, it is desirable to manufacture a single, free piston Stirling machine which can be operated by itself or alternatively may be connected with another identical machine and run in a desired synchronism with its operating characteristics being identical whether it is operated alone or in synchronism with another machine. This could not be done with prior art arrangements because connecting the machines in the conventional manner increases gas space volumes and therefore changes the operating characteristics.

It is also desirable in some design situations to align free piston Stirling machines along a common axis of reciprocation with the hot ends of each machine juxtaposed to receive heat from a single heat source. This or other reasons sometimes require that the gas spaces must be separated by such a substantial distance so that corresponding gas spaces cannot simply be interconnected and designed to operate as a single gas space.

There is therefore a need for an apparatus and method which permits two free piston Stirling machines to be operated in synchronism, but also permits each to be designed and operated with its own gas spaces in a manner such that connection of the machine to a second machine will not alter the design parameters or operation of either machine.

For example, such operation would be desirable when two, separate free piston Stirling engines are aligned in opposed orientation along a common axis of reciprocation. If such machines can be operated with their work space pressure waves in phase with each other, then their reciprocating parts will move in phase opposition, that is 180 degrees out of phase, so that the vibrations generated by each will be cancelled.

BRIEF DISCLOSURE OF INVENTION

The present invention is an improvement for synchronizing the relative phase of a pair of free piston Stirling machines which are designed to operate at the same frequency. Each Stirling machine includes at least one chamber which confines a gas, operates as a spring, and acts upon a reciprocating component of its machine. Such chambers include the working gas space, a gas spring acting upon the displacer or a gas spring acting upon the piston.

The machines are synchronized by connecting a sonic waveguide or transmission line between the chambers in a manner such that sonic energy is coupled from the corresponding gas space of each machine into the interconnected transmission line or waveguide to compensate for small losses and generate a standing wave in the transmission line. Thus, the transmission line must have a length greater than an insubstantial fraction of the wavelength of the transmission guide medium at the frequency of the operation in order to permit the standing wave to be set up in the waveguide during operation. Preferably the waveguide is a body, such as a tube, having a passageway in communication with both of the chambers and containing the same gas as contained within the chambers. By making the waveguide exactly one wavelength long, two axially opposed free piston Stirling engines of similar design can be made to operate in a manner which cancels their vibration.

Figure 1:
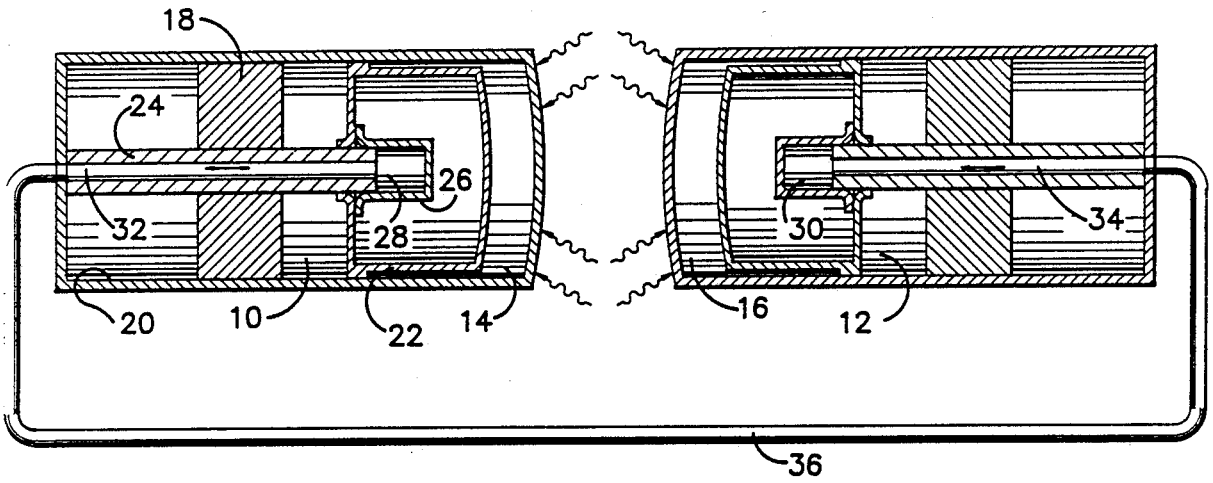
FIG. 1 is a diagrammatic view in axial section illustrating a pair of opposed free piston Stirling engines connected by a sonic waveguide or transmission line in the manner embodying the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION

FIG. 1 illustrates a pair of free piston Stirling engines 10 and 12 which are aligned along a common axis of reciprocation and in opposed orientation so that the two engines can be run in opposition and to thereby cancel vibration while maintaining the hot ends 14 and 16 of each in juxtaposition for the central application of heat from a single burner. Since the engines are identical, only one will be briefly described. For example, the engine 10 has a reciprocating power piston 18 mounted within the cylinder 20 in which there is also mounted the reciprocating displacer 22. Ordinarily a conventional regenerator is also connected to each engine as are other mechanical structures which are known to those skilled in the art and are not illustrated in these diagrams because they do not directly cooperate with the present invention. The displacer 22 and the piston 18 reciprocate along a fixed central rod 24 which extends into a small gas spring cylinder 26 which provides a gas spring chamber 28 confining a gas to provide a gas spring acting upon the displacer 22.

In accordance with the present invention the gas spring chambers 28 and 30, of the respective Stirling engines, are connected together by means of passageways 32 and 34 in each of the Stirling engines and an interconnecting tube 36.

Figure 2:
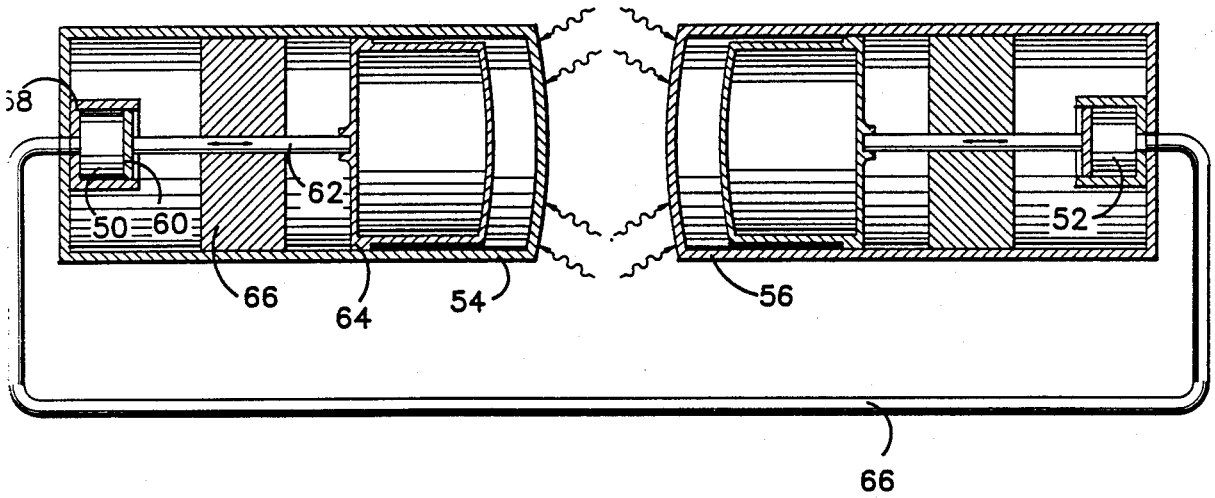
FIG. 2 illustrates yet another alternative and preferred embodiment of the invention.

FIG. 2 illustrates a similar free piston Stirling engine, different, however, in that the gas springs 50 and 52 for the two Stirling engines 54 and 56 are each positioned at the distally opposite ends of the respective aligned machines. For example, the gas spring 50 of Stirling machine 54 is constructed of a small cylinder 58 in which a piston 60 reciprocates. The piston 60 is fixed to a rod 62 which in turn is fixed to the displacer 64 and the piston 66 slides along that rod 62. The gas springs 50 and 52 are interconnected by a tube 66.

In order to force the free piston Stirling pairs of FIG. 1 or FIG. 2 to operate with their gas pressure waves in phase so that they will run with their reciprocating parts in opposition as a result of their opposed alignment, the length of the tubular waveguide connecting the two machines is made equal to the wavelength of the gas in the gas springs. This gas is ordinarily the same as the working gas, such, as for example, helium.

As is well known, the wavelength of a sonic wave in a gas is equal to the speed of sound in the gas divided by the frequency of operation. The speed of sound in the gas is equal to the square root of the product of the ratio to specific heats times the universal gas constant times the temperature of operation. For example, for a machine operating at 150 Hz with helium, one wavelength is 8.9 meters.

During operation, sonic energy from each of the gas spaces, such as the gas springs 50 and 52, is coupled into the interconnected tube, such as 36 or 66 in FIGS. 1 and 2, which operates as a sonic waveguide or transmission line. The dynamic equations for the operation of this arrangement has only two solutions, one for the machines running with their vibrating masses in opposition to cancel vibration and the other for their masses moving in unison. The latter solution, however, is a physical impossibility because if the embodiments of FIGS. 1 or 2 ran in unison all gas space volumes would remain identical and therefore would provide no effective spring constant. Thus, it is only physically possible for the Stirling machines, connected in accordance with the present invention as illustrated in FIGS. 1 and 2 with a one wavelength transmission line, to operate in the desired mode of cancelling the opposition.

With such an arrangement a pressure wave is imposed on each end of the interconnecting waveguide. If the waveguide was ideal and therefore had no energy losses resulting from hysteresis and other physical losses, a pure standing wave would be induced between the ends of the waveguide and as a result, each of the interconnected chambers, so long as it was running in phase with its counterpart, would not see or be influenced by the interconnection.

In reality there is, of course, a slight energy loss within the interconnecting waveguide and therefore a minute amount of energy sufficient to supply such losses is input from each end. Nonetheless, principally a standing wave is created within the waveguide. In this manner the present invention causes the two Stirling engines to operate in phase synchronism as if they were directly connected together and shared a common, single gas space, when, in fact, they are not. Yet they do so without any change in the effective volume of the interconnected spaces resulting from the interconnection. Therefore, the two machines can operate in exactly the same mode and at the same frequency as they would operate if they were operating alone in the absence of any interconnection.

The equilibrium condition for the embodiments of FIGS. 1 and 2 is with the pressure waves of the opposed gas springs in phase so that the reciprocating bodies are simultaneously reciprocating in opposite directions. If, however, this equilibrium should become unbalanced so that one machine is relatively leading and the other is relatively lagging, the relatively leading machine will couple additional energy into its end of the interconnected transmission line because the pressure wave in its gas spring will lead the pressure wave at the end of the transmission line. At the opposite end, this same energy will be coupled into the relatively lagging machine's gas spring because its gas spring will be relatively lagging the pressure wave from the opposite end of the interconnecting transmission line. Thus, a small amount of energy will be coupled from the relatively leading machine to the relatively lagging machine which will retard the phase of the relatively leading machine and advance the phase of the relatively lagging machine until they are again brought into synchronism at the equilibrium condition.

Figure 3:
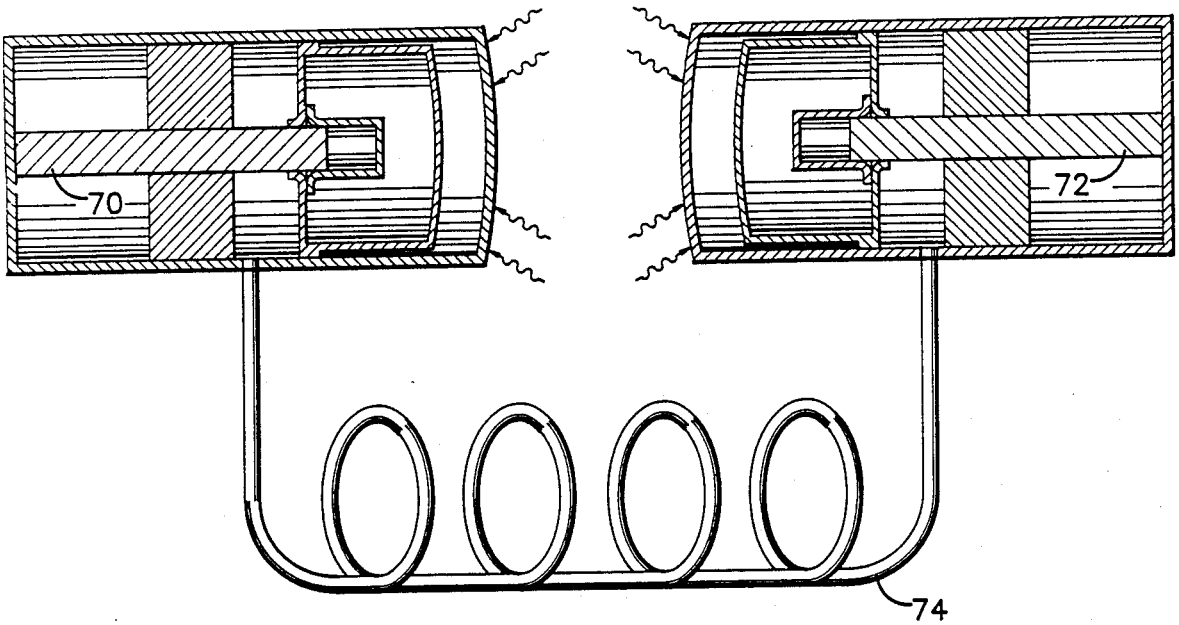
FIG. 3 illustrates an alternative embodiment of the invention.

FIG. 3 illustrates an embodiment in which the work spaces 70 and 72 are interconnected by a tube 74 forming the interconnecting waveguide or transmission line. Since the distance between the connections to the two machines may be less than one wavelength apart, the tube may be coiled in smooth contours so that it maintains the identical characteristic impedance along its length and thus avoids energy reflections.

Figure 4:
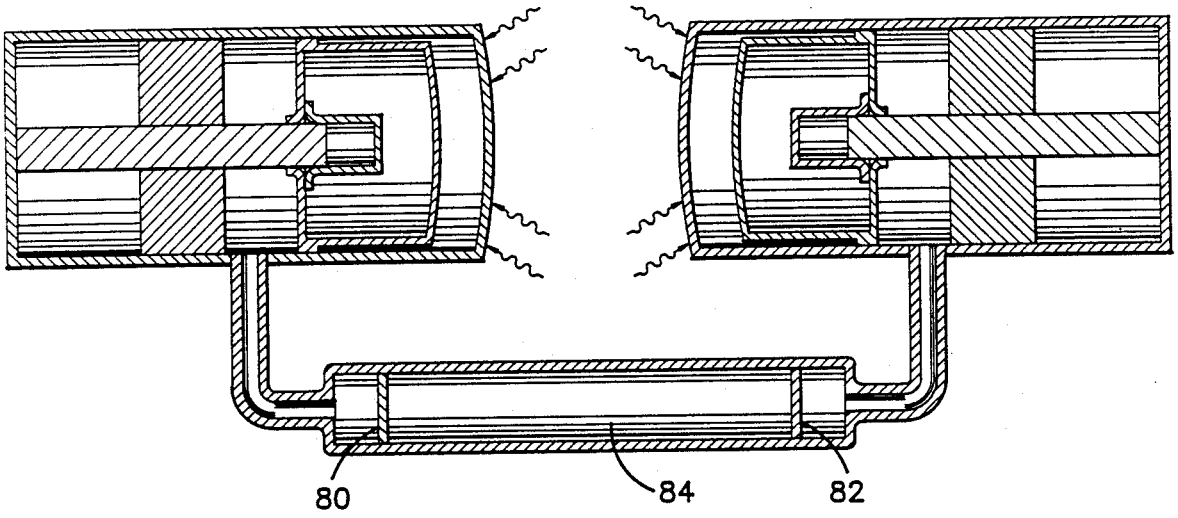
FIG. 4 illustrates yet another alternative embodiment of the invention.

Energy may be coupled from corresponding gas spaces of the two Stirling machines by other sonic waveguides or transmission lines. It may, for example, be electrically or magnetically coupled or it may be mechanically coupled as illustrated in FIG. 4. In FIG. 4 each of the two gas spaces has a piston 80 and 82 respectively which are connected by a gas space 84 acting as a spring for transmitting the sonic waves. This and other structures can be used to physically shorten the sonic transmission line while maintaining its wavelength.

Various other alternatives may also be accomplished with the present invention. For example, the interconnecting waveguide instead may be one-half wavelength long and cause the two engines to run with their pressure waves 180 degrees out of phase and their reciprocating bodies, running in synchronous, identical motion. Such an arrangement would maximize the vibration which would, for example, be desirable for a free cylinder type of free piston Stirling engine in which the output energy is taken from the external cylinder block.

If the waveguide is made an integral multiple of the wavelength at the operating frequency, then the pressure waves in the two gas spaces will operate 180 degrees out of phase for odd integral multiples and will operate in phase for even integral multiples. Of course, the machines can be coaxially aligned in the identical orientation and interconnected by a half wavelength transmission line so that they would then operate to cancel vibration.

Two free piston Stirling engines may also be made to operate at other selected phase angles A between the pressure variations in their corresponding chambers by connecting them by means of an interconnected transmission line so that the ratio of the desired phase angle A to 360 degrees equals the ratio of the transmission line effective length to the wavelength. Thus, transmission lines connected in accordance with the present invention may operate on a multiplicity of independent free piston Stirling machines to maintain a desired phase angle between all of them.

Although the transmission lines illustrated are distributed transmission lines, transmission lines of discrete components can be made by using mechanical or fluidic devices which are analogous to electrical reactances and for electrical coupling may be reactances.

Any transmission line has inherent energy storing capabilities which are analogous to electrical reactance. During transient start up, energy must be stored in this reactance before steady state operation is reached. It has been found, for example, that the diameter of the interconnecting tube has a significant effect on the response time at start up until the two machines come into synchronism. The larger the diameter the more energy which must be stored and therefore the longer the response time. On the other hand, while the tube can be relatively small it must not be so small that it cannot couple sufficient energy from one end to the other in order to maintain the equilibrium.

While certain preferred embodiments of the present invention have been disclosed in detail, it is to be understood that various modifications may be adopted without departing from the spirit of the invention or scope of the following claims.

I claim:

1. An improvement for synchronizing the phase of a pair of free piston Stirling machines designed to operate at the same frequency, each Stirling machine including at least one chamber confining a gas operating as a spring and acting upon a reciprocating component of its machine, wherein the improvement comprises:

a sonic waveguide connected between said chambers, having a sonic wavelength which is sufficiently greater than an insubstantial fraction of a wavelength at said frequency to permit a standing wave to be set up in the waveguide during operation.

2. An apparatus in accordance with claim 1 wherein the length L of the waveguide for the desired phase angle A in degrees between the pressure variations of said chambers is substantially equal to $$A = 360\left[\frac{L}{1}\right]$$

wherein: 1 = the wavelength in the waveguide at the operating frequency.

3. An apparatus in accordance with claim 1 or 2 wherein the waveguide is a body having a passageway in communication with both of said chambers and containing said gas.

4. An apparatus in accordance with claim 3 wherein the waveguide is connected between gas springs acting upon the displacer of each Stirling machine.

5. An apparatus in accordance with claim 3 wherein the sonic waveguide is connected between the work space of each Stirling machine.

6. An apparatus in accordance with claim 1 or 2 wherein the Stirling machines have substantially the same effective energy of vibration and are aligned in opposed, coaxial orientation and wherein the sonic waveguide has an effective length of substantially an integral multiple of one sonic wavelength at the operating frequency for balancing the axial vibration of said machines.

7. An apparatus in accordance with claim 6 wherein the waveguide is body having a passageway in communication with both of said chambers and containing said gas.

8. An apparatus in accordance with claim 7 wherein the waveguide is connected between gas springs acting upon the displacer of each Stirling machine.

9. An apparatus in accordance with claim 7 wherein the sonic waveguide is connected between the work space of each Stirling machine.

10. An apparatus in accordance with claim 1 or 2 wherein the sonic waveguide has a length of substantially an integral multiple of one-half the sonic wavelength at the operating frequency.

11. A method for synchronizing two free piston Stirling machines designed to operate at the same frequency so that they maintain a substantially constant phase angle between them, the method comprising:

coupling sonic energy from a gas space of each machine into an interconnected sonic transmission line to generate a standing wave in the transmission line.

12. A method in accordance with claim 11 for additionally at least partially counterbalancing the vibration of the machines, the method further comprising aligning the machines in opposed orientation along a common axis of reciprocation.

* * * * *